US006640146B2

(12) United States Patent
Burbidge

(10) Patent No.: US 6,640,146 B2
(45) Date of Patent: Oct. 28, 2003

(54) GOLF HANDICAPPING AND SCORING SYSTEM

(76) Inventor: Daniel Burbidge, 6102 Palo Alto Dr., Huntington, CA (US) 92647

( * ) Notice: Subject to any disclaimer, the term of this patent is extended or adjusted under 35 U.S.C. 154(b) by 358 days.

(21) Appl. No.: 09/829,127

(22) Filed: Apr. 9, 2001

(65) Prior Publication Data

US 2002/0147513 A1 Oct. 10, 2002

(51) Int. Cl.[7] ..... G06F 155/00; A63F 9/24
(52) U.S. Cl. ..... 700/91; 345/905; 463/46
(58) Field of Search ..... 473/131, 407, 473/409; 700/91–92; 345/905; 463/1, 46, 43

(56) References Cited

U.S. PATENT DOCUMENTS 4,266,214 A * 5/1981 Peters, Jr.

OTHER PUBLICATIONS

Apple's Macworld Expo Surprise: iBook–Apple's Consumer Portable', by Graeme Bennett, (www.macbuyers-guide.com/hardware/system/iBook–review.html), last updated Aug. 5, 2000, 3 pages.*

* cited by examiner

*Primary Examiner*—Mark Sager
(74) *Attorney, Agent, or Firm*—Goldstein & Lavas, P.C.

(57) ABSTRACT

A golf handicapping and scoring system including a portable display including a viewable screen as a first section and a key board as a second section. The first section and the second section are hingedly coupled together whereby the first section can be closed over the second section in a closed orientation and opened in a co-planar relationship in an open orientation. The first section has a linear groove formed therein disposed above the viewable screen. The portable display has an internal central processing unit. The central processing unit is programmed for performing golf-related tasks. The golf-related tasks includes tabulating a golfer's handicap and keeping shot-by-shot information for each golf hole played.

1 Claim, 3 Drawing Sheets

GOLF HANDICAPPING AND SCORING SYSTEM

BACKGROUND OF THE INVENTION

The present invention relates to a golf handicapping and scoring system and more particularly pertains to allowing a golfer to keep track of his handicap while also keeping score during a round of golf and enter and save data related to each hole played.

The use of electronic score keeping devices is known in the prior art. More specifically, electronic score keeping devices heretofore devised and utilized for the purpose of keeping score while playing golf are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,795,237 to Miyamoto discloses a portable electronic golf score keeping device comprised of an LCD, keyboard and memory, capable of storing course related information. U.S. Pat. No. 5,683,303 to Lambourne discloses an electronic golf scorecard capable of storing each player's related information and score on an individual hole and has means for keeping track of related golfing data. U.S. Pat. No. 4,864,592 to Lee discloses an electronic golf scoring device with means to display hole number, par value, fairway and putting strokes.

While these devices fulfill their respective, particular objective and requirements, the aforementioned patents do not describe a golf handicapping and scoring system for allowing a golfer to keep track of his handicap while also keeping score during a round of golf and enter and save data related to each hole played.

In this respect, the golf handicapping and scoring system according to the present invention substantially departs from the conventional concepts and designs of the prior art, and in doing so provides an apparatus primarily developed for the purpose of allowing a golfer to keep track of his handicap while also keeping score during a round of golf and enter and save data related to each hole played.

Therefore, it can be appreciated that there exists a continuing need for a new and improved golf handicapping and scoring system which can be used for allowing a golfer to keep track of his handicap while also keeping score during a round of golf and enter and save data related to each hole played. In this regard, the present invention substantially fulfills this need.

SUMMARY OF THE INVENTION

In the view of the foregoing disadvantages inherent in the known types of electronic score keeping devices now present in the prior art, the present invention provides an improved golf handicapping and scoring system. As such, the general purpose of the present invention, which will be described subsequently in greater detail, is to provide a new and improved golf handicapping and scoring system which has all the advantages of the prior art and none of the disadvantages.

To attain this, the present invention essentially comprises a portable display including a viewable screen as a first section and a key board as a second section. The first section and the second section are hingedly coupled together whereby the first section can be closed over the second section in a closed orientation and opened in a co-planar relationship in an open orientation. The first section has a linear groove formed therein disposed above the viewable screen. The portable display has an internal central processing unit. The central processing unit is programmed for performing golf-related tasks. The golf-related tasks includes tabulating a golfer's handicap and keeping shot-by-shot information for each golf hole played.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf handicapping and scoring system which has all the advantages of the prior art electronic score keeping devices and none of the disadvantages.

It is another object of the present invention to provide a new and improved golf handicapping and scoring system which may be easily and efficiently manufactured and marketed.

It is a further object of the present invention to provide a new and improved golf handicapping and scoring system which is of durable and reliable construction.

An even further object of the present invention is to provide a new and improved golf handicapping and scoring system which is susceptible of a low cost of manufacture with regard to both materials and labor, and which accordingly is then susceptible of low prices of sale to the consuming public, thereby making such a golf handicapping and scoring system economically available to the buying public.

Even still another object of the present invention is to provide a new and improved golf handicapping and scoring system for allowing a golfer to keep track of his handicap while also keeping score during a round of golf and enter and save data related to each hole played.

Lastly, it is an object of the present invention to provide a new and improved golf handicapping and scoring system including a portable display including a viewable screen as a first section and a key board as a second section. The first section and the second section are hingedly coupled together whereby the first section can be closed over the second section in a closed orientation and opened in a co-planar relationship in an open orientation. The first section has a linear groove formed therein disposed above the viewable screen. The portable display has an internal central processing unit. The central processing unit is programmed for performing golf-related tasks. The golf-related tasks includes tabulating a golfer's handicap and keeping shot-by-shot information for each golf hole played.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
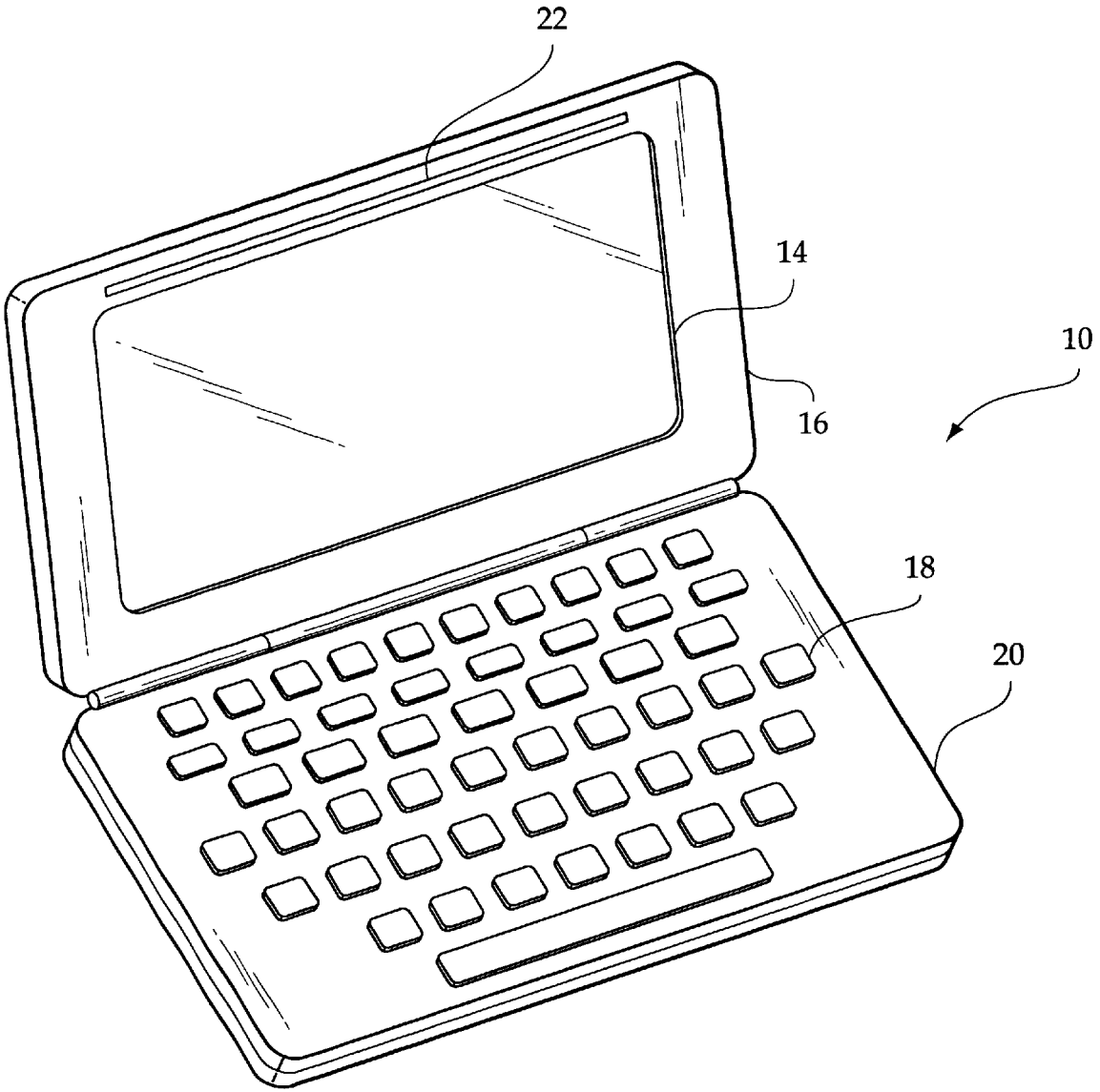
FIG. 1 is a perspective view of the preferred embodiment of the golf handicapping and scoring system constructed in accordance with the principles of the present invention.
Figure 4:
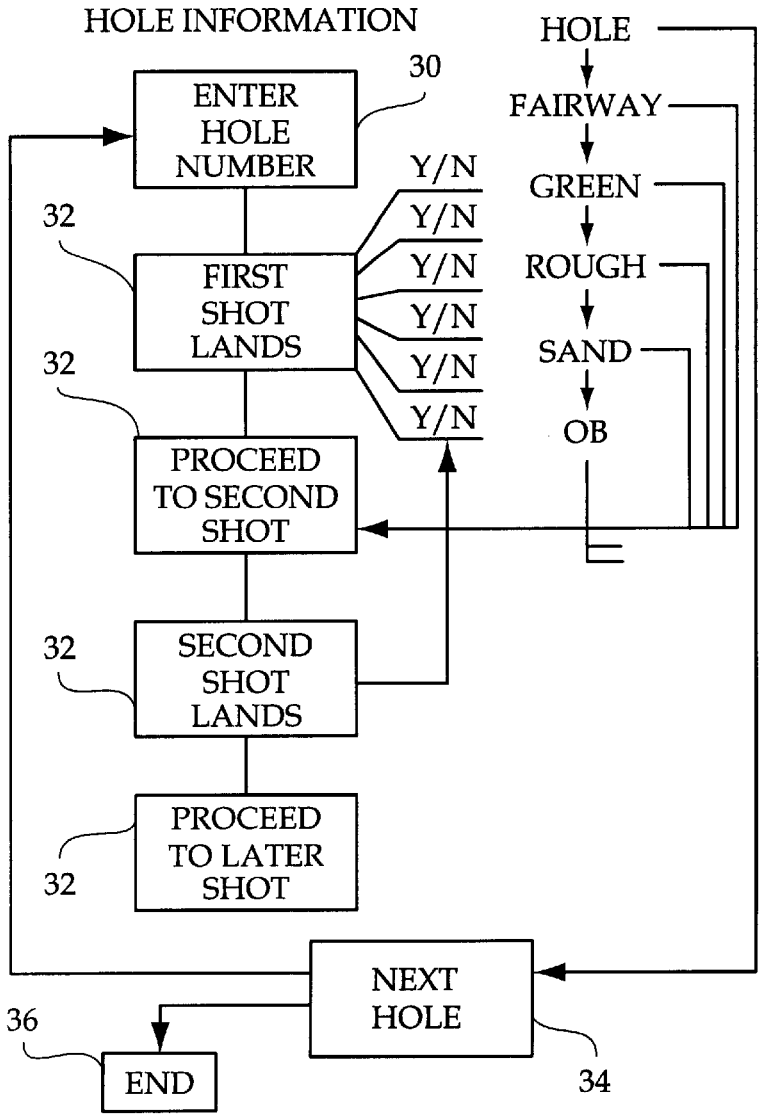
FIG. 4 is a flowchart illustrating the steps for entering information for a particular golf hole.

With reference now to the drawings, and in particular, to FIGS. 1 and 4 thereof, the preferred embodiment of the new and improved golf handicapping and scoring system embodying the principles and concepts of the present invention and generally designated by the reference number 10 will be described.

Specifically, it will be noted in the various figures that the device relates to a golf handicapping and scoring system for allowing a golfer to keep track of his handicap while also keeping score during a round of golf and enter and save data related to each hole played.

Figure 2:
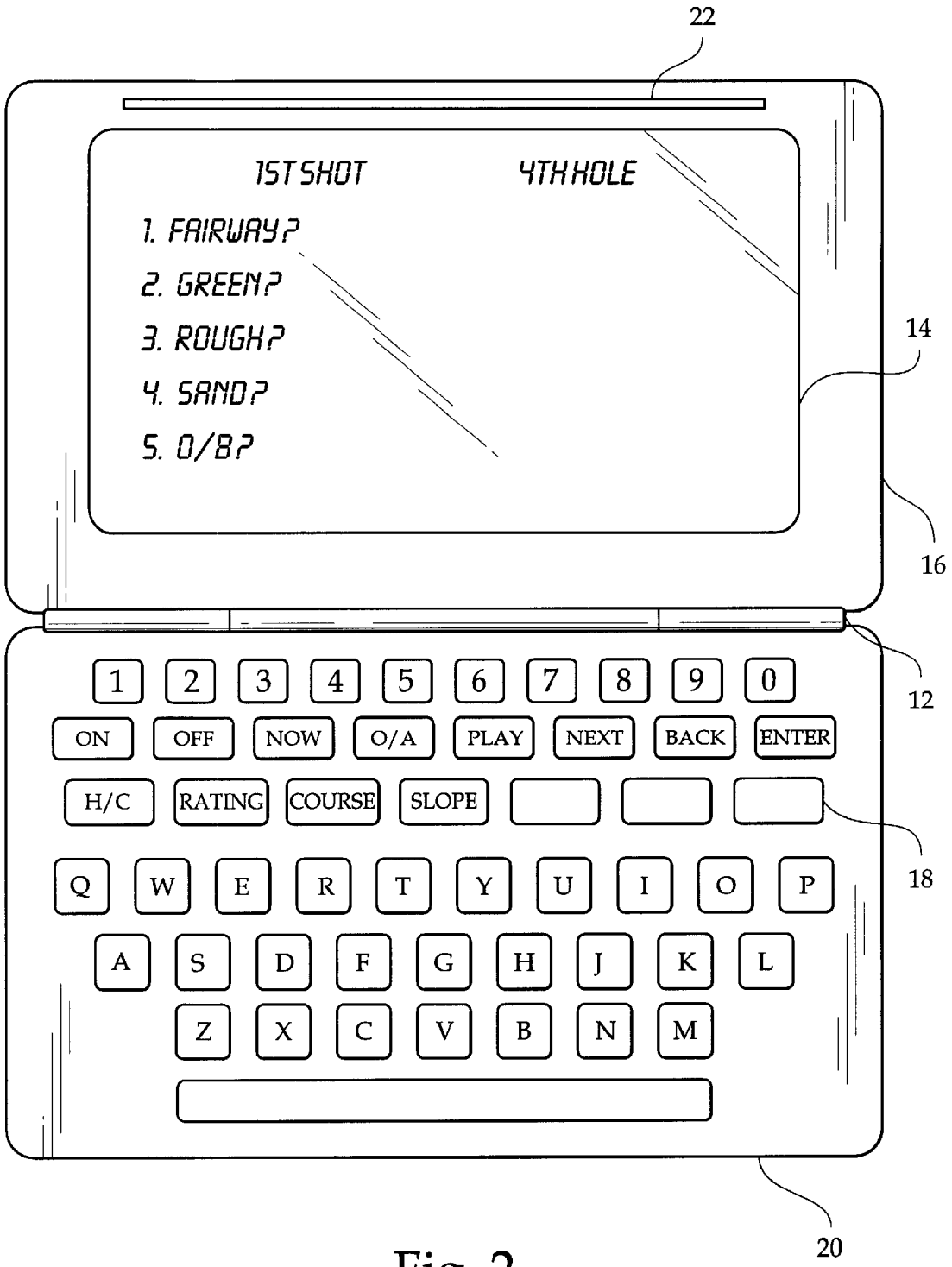
FIG. 2 is a plan view of the present invention illustrating the display and keyboard thereof.
Figure 3:
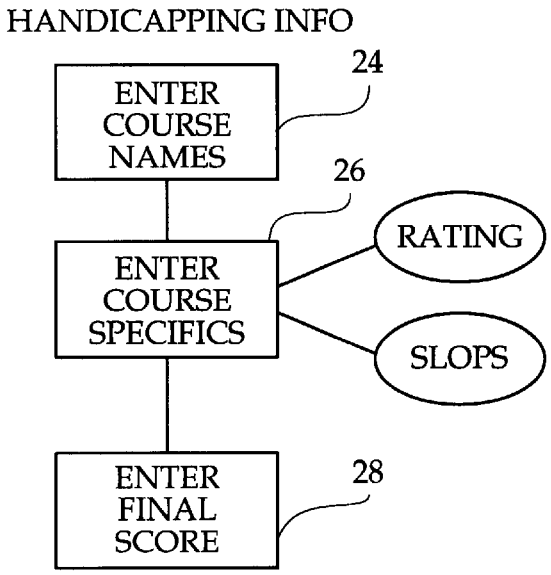
FIG. 3 is a flowchart illustrating the steps for entering a handicap.

The present invention is essentially comprised of a portable display 12. The portable display 12 includes a viewable screen 14 as a first section 16 and a key board 18 as a second section 20. The first section 16 and the second section 20 are hingedly coupled together whereby the first section 16 can be closed over the second section 20 in a closed orientation and opened in a co-planar relationship in an open orientation. Note FIGS. 1 and 2. The first section 16 has a linear groove 22 formed therein disposed above the viewable screen 14. The linear groove 22 allows the portable display to be secured to a golf cart steering wheel's clip that is normally used to hold a standard score card. The portable display 12 has an internal central processing unit. The central processing unit is programmed for performing golf-related tasks. The golf-related tasks includes tabulating a golfer's handicap and keeping shot-by-shot information for each golf hole played. The user will use the key board to enter in all of the relevant data needed in order for the central processing unit to process the information. In order for the device 10 to tabulate the golfer's handicap, the user must first enter the course name 24, so that the information can be recalled at a later date. Next, the user enters the course specifics 26, namely the rating and slope. Lastly, the golfer will enter his final score 28 so the central processing unit can compute the handicap. Note FIG. 3.

The present invention can also be used to process information while the golfer is playing a round of golf, including maintaining the scores for a plurality of golfers during a round. The present invention can maintain information related to each hole played so that the golfer can learn where the strong and weak portions of their game are. The process, as illustrated in FIG. 4, starts with the entering of a specific hole number 30. Next, the golfer will enter information relative to each shot 32 played for the hole. For each shot made, the golf ball will land either in the hole, in the fairway, on the green, in the rough, in the sand, or out of bounds. Once the hole is completed, the process will continue with the next hole 34. Once the round has been completed, the process will be completed 36.

Additionally, the information gathered by the present information could be used to provide an individual rating system which would show the golfer on the viewable screen 14 how each part of their game rates.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf handicapping and scoring system for allowing a golfer to keep track of his handicap while also keeping score during a round of golf and enter and save data related to each hole played comprising, in combination:

a portable display including a viewable screen on a first section and a key board as a second section, the first section and the second section being hingedly coupled together whereby the first section can be closed over the second section in a closed orientation and opened in a co-planar relationship in an open orientation, the first section having a linear groove formed therein disposed above the viewable screen, the portable display having an internal central processing unit, the central processing unit being programmed for performing golf-related tasks, the golf-related tasks including tabulating a golfer's handicap and keeping shot-by-shot information for each golf hole played.

* * * * *